US006072306A

United States Patent [19]

Dondale

[11] Patent Number: 6,072,306

[45] Date of Patent: Jun. 6, 2000

[54] VARIATION-COMPENSATED BIAS CURRENT GENERATOR

[75] Inventor: Charles Stephen Dondale, Fort Collins, Colo.

[73] Assignee: LSI Logic Corporation, Milpitas, Calif.

[21] Appl. No.: 09/211,468

[22] Filed: Dec. 14, 1998

Related U.S. Application Data

[62] Division of application No. 08/884,725, Jun. 30, 1997, Pat. No. 5,864,230.

[51] Int. Cl.[7] ..... G05F 3/04; G05F 1/10

[52] U.S. Cl. ..... 323/312; 327/538

[58] Field of Search ..... 323/269, 270, 323/273, 312, 313; 327/512, 513, 535, 538, 539

[56] References Cited

U.S. PATENT DOCUMENTS

| | | | |
|---|---|---|---|
| 4,100,478 | 7/1978 | Tam | 323/19 |
| 5,180,966 | 1/1993 | Sugawara et al. | 323/308 |
| 5,488,328 | 1/1996 | Ludwig et al. | 327/538 |
| 5,581,174 | 12/1996 | Fronen | 323/316 |
| 5,581,209 | 12/1996 | McClure | 327/538 |
| 5,587,655 | 12/1996 | Oyabe et al. | 323/312 |
| 5,604,427 | 2/1997 | Kimura | 323/313 |
| 5,629,611 | 5/1997 | McIntyre | 232/313 |
| 5,672,962 | 9/1997 | Sweeney | 323/315 |
| 5,675,243 | 10/1997 | Kamata | 323/313 |
| 5,859,560 | 1/1999 | Matthews | 327/513 |

FOREIGN PATENT DOCUMENTS

| | | | |
|---|---|---|---|
| 56-7117 | 1/1981 | Japan | 323/312 |

*Primary Examiner*—Matthew Nguyen

[57] ABSTRACT

The present invention includes at least two variable-resistive devices, such as transistors, coupled to a resistive device, such as a resistor. The transistors are configured so that feedback voltage generated by respective currents of the transistors is applied to the gate of at least one of the transistors. The electrical characteristics of the other transistor changes proportionately greater than the characteristics of the one transistor. With this configuration, a variation-compensated current device is provided.

10 Claims, 3 Drawing Sheets

VARIATION-COMPENSATED BIAS CURRENT GENERATOR

This is a division, of application Ser. No. 08/884,725, filed Jun. 30, 1997 U.S. Pat. No. 5,864,230.

FIELD OF THE INVENTION

The present invention relates to integrated circuits and more particularly to a variation-compensated bias current generator.

BACKGROUND OF THE INVENTION

FIG. 1 shows a bias current generator 100 that can be used in a current mirror circuit. As illustrated, a power supply (not shown) is coupled to a source lead 105 of a p-channel transistor 110. A gate lead 115 and a drain lead 120 of transistor 110 are coupled together via a lead 125. Transistor 110 functions as a diode in this arrangement. Drain lead 120 is coupled to a resistor 130, which is coupled to a reference voltage supply 140 via a lead 135.

Current generator 100 operates by having a power supply voltage $V_{DD}$ applied to source lead 105. This causes a current $I_{110}$ through transistor 110 and a voltage drop $V_{110}$ across transistor 110. Since transistor 110 is in saturation, voltage drop $V_{110}$ will be a function of current $I_{110}$. The voltage at node 145 ($V_{145}$) will be constant due to this voltage drop, and equal to $V_{DD}-V_{110}$.

All of current $I_{110}$ is applied to resistor 130 to cause a voltage drop across resistor 130 ($V_{130}$) equal to $I_{110}$33 $R_{130}$. Yet $I_{110}\times R_{130}$ must equal the constant voltage $V_{145}$ ($V_{DD}$31 $V_{110}$) at node 145. Any variation of the voltage $V_{145}$ will be applied through lead 125 to gate lead 115 to adjust the "tum-on" level of transistor 110. As a result, current $I_{110}$ will change so that, eventually, $I_{110}\times R_{130}$ equals the voltage at node 145. Hence, a constant current source is provided.

The operation of current generator 100 discussed above is ideal. In other words, variations in power supply voltage, temperature or the fabrication processes will cause current generator 100 to provide different current amounts. In particular, one disadvantage of current generator 100 is that the voltage from a power supply (e.g., $V_{DD}$), the temperature or the process variations can cause as much as a threefold change in the value of current $I_{110}$. This can cause inconsistent and possibly erroneous operation of a circuit that utilizes current generator 100.

For example, a device including current generator 100 may be used in an environment where the power supply voltage is susceptible to noise. This noise will alter the current provided by current generator 100. Also, that device may be used in applications where the ambient temperatures can be between minus 55° C. to positive 125° C. These temperature variations can cause a change in the current provided by current generator 100, which can have an adverse affect on device performance.

To illustrate, the operation of current generator 100 will be explained for two ambient temperatures. For temperature 1, a steady-state current $I_{110}'$ will be generated. For a temperature 2 that is greater than temperature 1, the resistance of transistor 110 will increase. As a result, the current $I_{110}$ will decrease, causing the voltage $V_{145}$ to decrease. The decreased voltage $V_{145}$ will be applied to the gate of transistor 110 to turn that transistor on harder. Current $I_{110}$ will then increase, but still be less than the steady-state current $I_{110}'$. Thus, a constant current will not be generated over a range of temperature variations.

A band gap circuit-based current source can be used to overcome this disadvantage. One such circuit is disclosed in U.S. Pat. No. 5,629,611 to McIntyre entitled "CURRENT GENERATOR CIRCUIT FOR GENERATING SUBSTANTIALLY CONSTANT CURRENT." The drawback to such current source is that it is a physically large circuit due to its use of many circuit elements. See FIG. 2 in the referenced patent. This is unacceptable since silicon area of integrated circuits is costly.

A need exists for a device that will provide a substantially constant current source or sink despite voltage, temperature and process variations. The present invention meets this need.

SUMMARY OF THE INVENTION

The present invention includes at least two variable-resistive devices, such as transistors, coupled to a resistive device, such as a resistor. The transistors are configured so that feedback voltage generated by respective currents of the transistors is applied to the gate of at least one of the transistors. The electrical characteristics of the other transistor changes proportionately greater than the characteristics of the one transistor. With this configuration, a variation-compensated current device is provided.

Numerous other advantages and features of the present invention will become readily apparent from the following detailed description of the invention and the embodiments thereof, from the claims and from the accompanying drawings in which details of the invention are fully and completely disclosed as a part of this specification.

DETAILED DESCRIPTION OF THE PREFERRED EMBODIMENT

Figure 1:
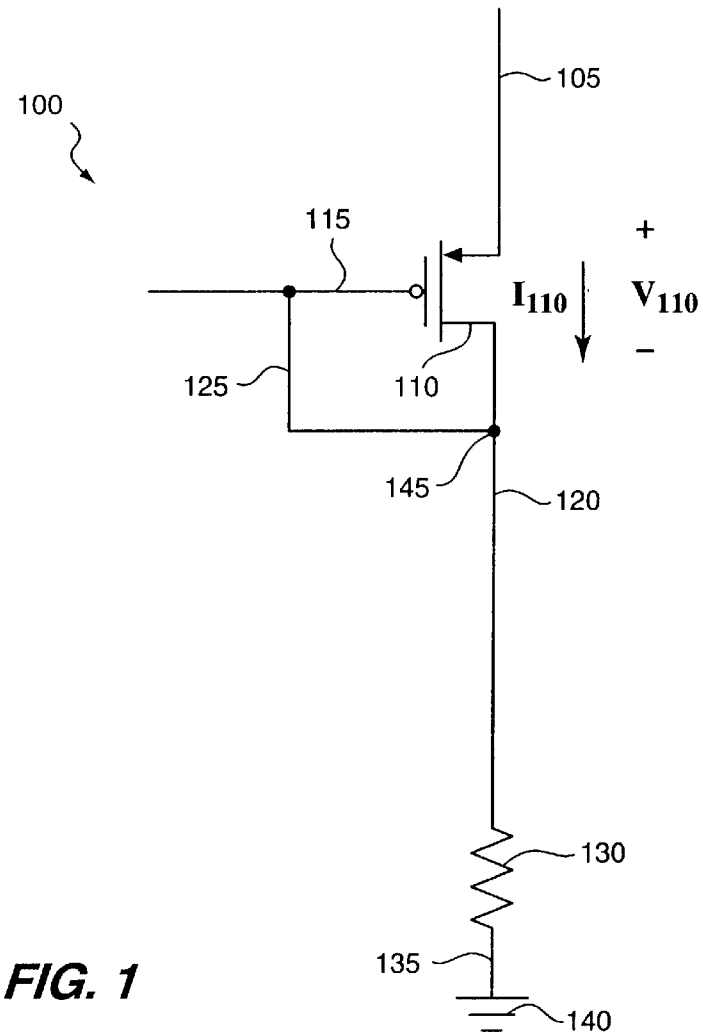
FIG. 1 is a schematic of a current source.

While this invention is susceptible of embodiment in many different forms, there is shown in the drawings and will be described herein in detail specific embodiments thereof with the understanding that the present disclosure is to be considered as an exemplification of the principles of the invention and is not to be limited to the specific embodiments described.

Figure 2:
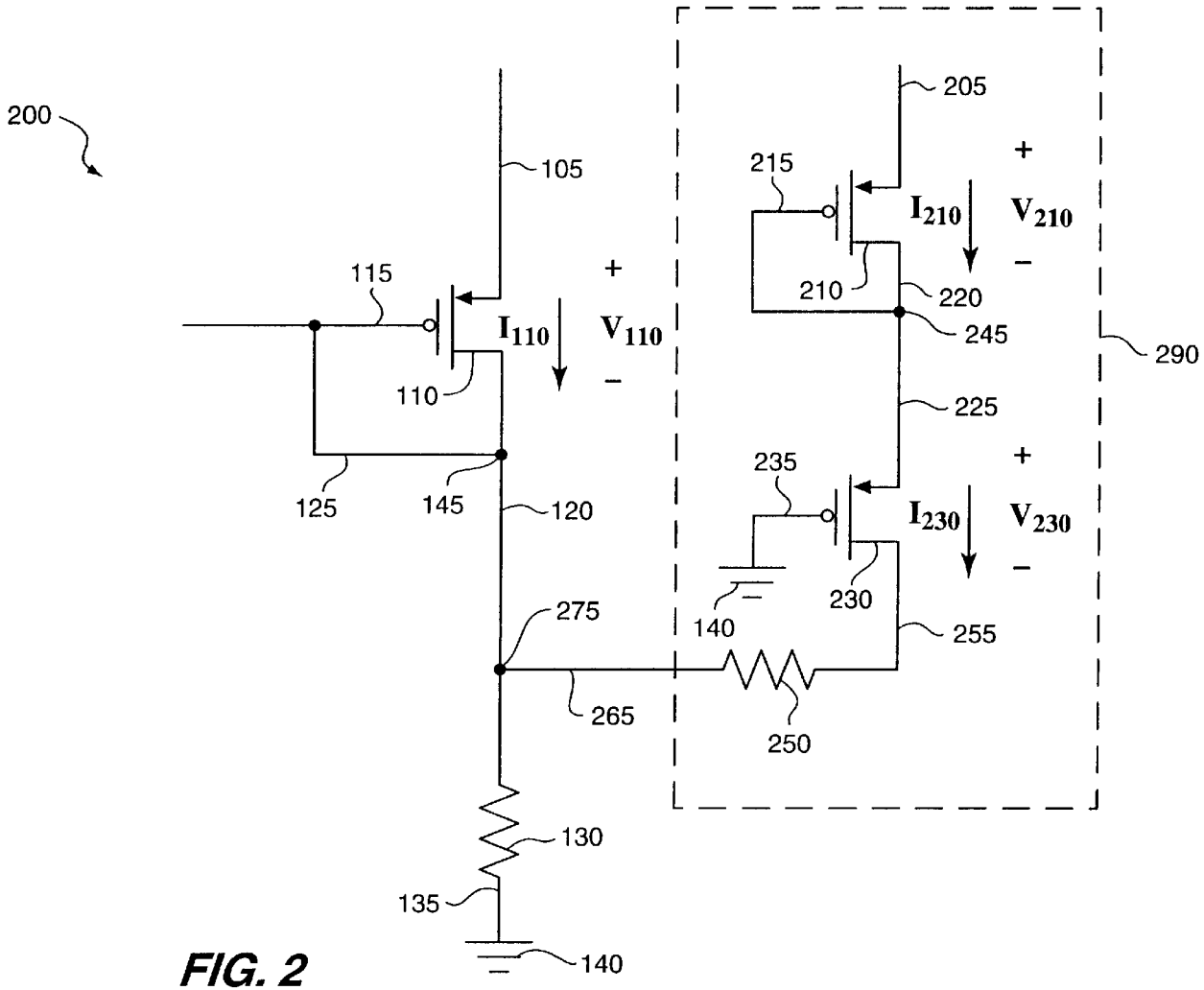
FIG. 2 is a schematic of an embodiment of a variation-compensated current source according to the present invention.

FIG. 2 illustrates an embodiment of the present invention. A variation-compensated bias current generator (VCBCG) 200 includes current generator 100 of FIG. 1. VCBCG 200 also includes a source lead 205 coupled to a source of a p-channel transistor 210. A gate and a drain of p-channel transistor 210 are coupled together at node 245 by a gate lead 215 and a drain lead 220. A source lead 225 is coupled to node 245 and a source of a p-channel transistor 230. A gate of transistor 230 is coupled to reference voltage supply 140 via a gate lead 235. A drain of p-channel transistor 230 is coupled to a resistor 250 via a lead 255. Resistor 250 is coupled to a node 275 via a lead 265. Node 275 is coupled to node 145 and resistor 130 as shown.

It is preferred that the channel length of transistor 210 is a minimum compared to the non-minimum channel length of transistor 110. The effect of this minimum length is that transistor 210 will have greater changes in its electrical parameters or characteristics than transistor 110 when the power, temperature or process varies. In this manner, transistor 210 can compensate for the changes in the electrical parameters characteristics of transistor 110 due to those variations.

In steady-state operation, current $I_{210}$ equals current $I_{230}$. The current through resistor 130 equals $I_{110}+I_{210}$. The voltage at node 275 ($V_{275}$) then equals $R_{130}\times(I_{110}+I_{210})$. Voltage $V_{275}$ is applied to the gate of transistor 110 through lead 125, which feedback maintains $I_{110}$. The voltage at node 245 ($V_{245}$) equals $V_{275}+(I_{210}\times R_{250})+V_{230}$, where $V_{230}$ is the voltage drop caused by transistor 230. Since the gate of transistor 230 is coupled to ground, transistor 230 is "fully" turned on and will have a minimal voltage drop. The voltage $V_{245}$ is applied to the gate of transistor 210 to maintain current $I_{210}$.

In variation-compensation operation, a temperature variation example will be explained. If the ambient temperature for bias current generator 200 increases, then the resistance of transistors 110 and 210 increase to cause a decrease in currents $I_{110}$ and $I_{210}$. The decreased currents cause less current to flow through resistor 130, thus causing decreased voltages $V_{275}$ and $V_{245}$. These decreased voltages will be applied directly to the gates of transistors 110 and 210, respectively, which will cause those transistors to turn on harder. This in turn will cause currents $I_{110}$ and $I_{210}$ to increase.

It should be noted that since the electrical characteristics of transistor 210 change proportionately greater than the characteristics of transistor 110, current $I_{210}$ will decrease proportionately greater than current $I_{110}$. The current through resistor 130 will change proportionately greater than the change in current $I_{110}$. Accordingly, the voltage $V_{145}$ at node 145 will decrease proportionately more under the influence of current $I_{120}$ than if only current $I_{110}$ were supplied. Thus, the proportionately greater decreased voltage $V_{145}$ at node 145 will cause transistor 110 to turn on even harder, thus increasing current $I_{110}$ more than if current $I_{210}$ was not provided.

It should be noted that the FIG. 2 circuit will also better compensate for voltage and process variations than the FIG. 1 circuit. Furthermore, although variation-compensation block 290 (shown as dashed lines) in FIG. 2 includes transistors 210 and 230, and resistor 250 transistor 210 can be used by itself to compensate for those variations. Transistor 230 is optional to provide an increased voltage at node 245. Resistor 230 is optionally included to compensate for characteristic variations of resistor 130. To this end, the electrical characteristics of resistor 250 preferably will change greater in proportion to variations than will the characteristics of resistor 130.

Generally, variation-compensation block 290 provides a function that compensates for the electrical characteristic changes of transistor 110 caused by variations such as voltage, temperature or process. This is preferably accomplished by providing a device or circuitry in block 290 that changes electrical characteristics proportionately greater than transistor 110.

Figure 3:
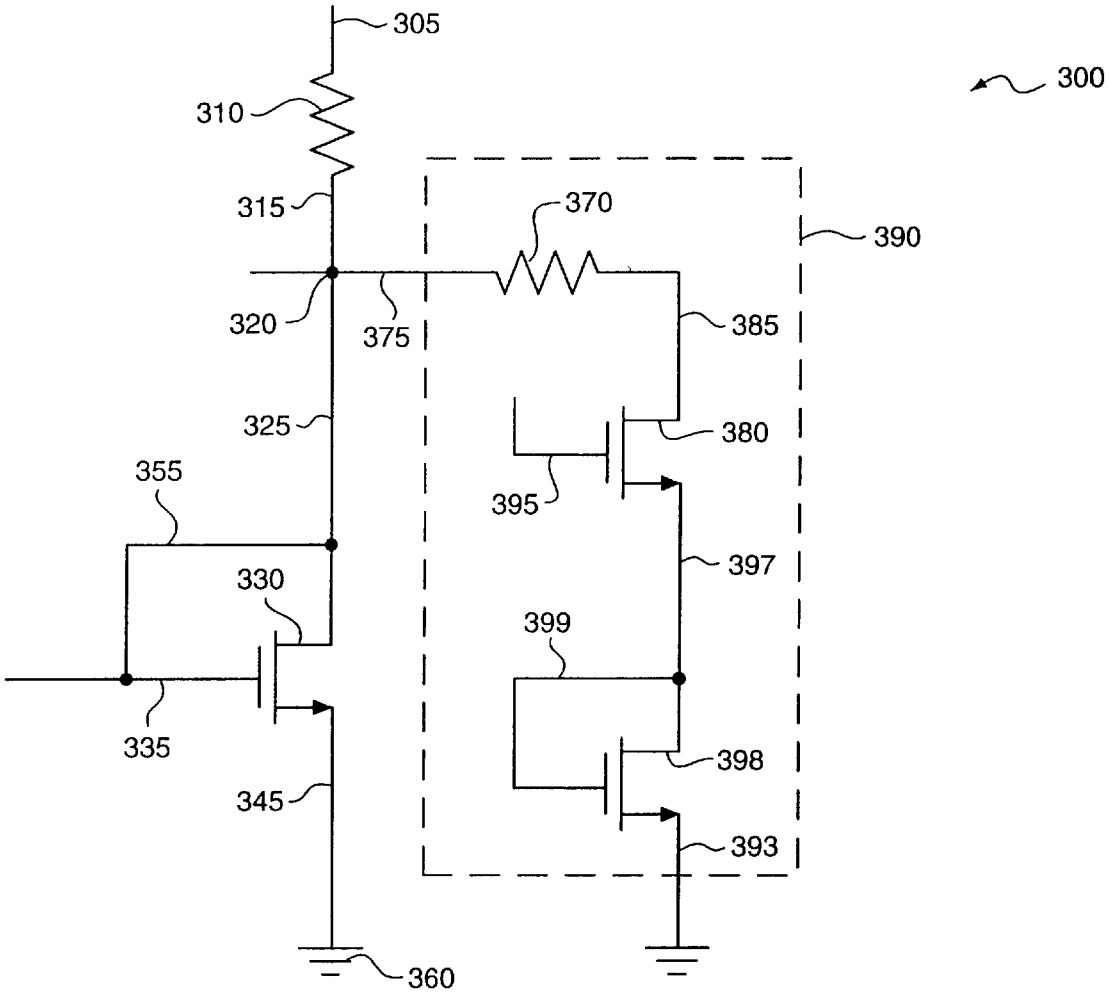
FIG. 3 is a schematic of another embodiment of the variation-compensated current source according to the present invention.

FIG. 3 shows another embodiment of the present invention. A constant current sink 300 includes a resistor 310 coupled to a power supply (not shown) via a lead 305. Resistor 310 is also coupled to a node 320 via a lead 315. Node 320 is coupled to a drain of a n-channel transistor 330 via a lead 325. A gate of transistor 330 is coupled to the drain of transistor 330 via lead 355. Lead 345 is coupled to a reference voltage supply 360 and the source of transistor 330.

A variation-compensation block 390 includes a resistor 370 coupled to node 320 via a lead 375. Resistor 370 is also coupled to a drain of a transistor 380 via a lead 385. A gate of a n-channel transistor 380 is coupled to the power supply (not shown) via a lead 395. A source of transistor 380 is coupled to a drain of a transistor 398 via a lead 397. A gate and a drain of a n-channel transistor 398 are coupled together via lead 399. Lead 393 couples the source of transistor 398 to reference voltage supply 360. One skilled in the art shall recognize that current sink 300 operates similarly to current generator 200 of FIG. 2.

One skilled in the art shall also recognize that transistors 110, 210, 330 and 398 are current devices. In particular, transistors 110 and 210 are current sources. Transistors 330 and 398 are current sinks. In addition, transistors 110, 210, 330 and 398 function as voltage-controlled variable resistance devices. The preferred dimensions of transistor 110 are 10μm/3 μm. The preferred dimensions of transistor 210 are 10μm/0.6μm. The preferred dimensions of transistor 230 are 1.5μm/0.6μm. The resistive values of resistors 130 and 250 are preferably 50 kΩ and 10 kΩ, respectively.

Numerous variations and modifications of the embodiment described above may be effected without departing from the spirit and scope of the novel features of the invention. It is to be understood that no limitations with respect to the specific device illustrated herein are intended or should be inferred. It is, of course, intended to cover by the appended claims all such modifications as fall within the scope of the claims.

I claim:

1. A current circuit comprising:

a current generator for generating a first current;

a variation-compensation block for generating a second current, wherein the block includes electrical characteristics that change greater in proportion to process, temperature or voltage variations than electrical characteristics of the current generator such that the second current changes more in proportion than the first current to changes in process, temperature or voltage;

a resistive element coupled to the current generator and the variation compensation block at a first node such that the resistive element receives the first current and the second current; and a negative feedback circuit coupled to the first node and the current generator such that changes in the voltage at the first node result in changes in the first current that decrease the changes in the voltage at the first node.

2. The circuit of claim 1 wherein the variation compensation block comprises a first CMOS transistor configured to operate as a diode.

3. The circuit of claim 1 wherein the current generator comprises a second CMOS transistor configured to operate as a diode.

4. The circuit of claim 1 wherein the resistive element comprises a resistor.

5. The circuit of claim 3 wherein the feedback circuit comprises the second CMOS transistor.

6. The circuit of claim 2 wherein the first CMOS transistor is a p-channel transistor.

7. The circuit of claim 3 wherein the second CMOS transistor is a p-channel transistor.

8. The circuit of claim 7 wherein the feedback circuit comprises the second CMOS transistor, and wherein the gate and drain of the second CMOS transistor are directly coupled to the first node such that the voltage at the gate and drain is equal to the voltage at the first node.

9. The circuit of claim 8 wherein the source of the second CMOS transistor is directly coupled to a power supply.

10. The circuit of claim 8 wherein the variation compensation block further comprises:

a third CMOS transistor that is a p-channel transistor, the gate of which is coupled to ground and the source of which is coupled to a second node;

a resistor coupled between the first node and the drain of the third CMOS p-channel transistor; and wherein the gate and drain of the second CMOS transistor are coupled to the second node.

* * * * *